US006921289B2

(12) United States Patent
Takahashi et al.

(10) Patent No.: US 6,921,289 B2
(45) Date of Patent: Jul. 26, 2005

(54) JOINT CONNECTOR AND ITS TERMINALS

(75) Inventors: Toshiharu Takahashi, Shizuoka (JP); Motoyoshi Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/790,685

(22) Filed: Mar. 3, 2004

(65) Prior Publication Data

US 2004/0175985 A1 Sep. 9, 2004

(30) Foreign Application Priority Data

Mar. 5, 2003 (JP) ..... 2003-058776

(51) Int. Cl.[7] ..... H01R 31/08
(52) U.S. Cl. ..... 439/507
(58) Field of Search ..... 439/507, 701, 439/287, 752, 679, 510, 511, 512, 49, 608, 680

(56) References Cited

U.S. PATENT DOCUMENTS

| | | | | | |
|---|---|---|---|---|---|
| 3,944,313 | A | | 3/1976 | McKeown et al. | 339/75 |
| 4,679,887 | A | | 7/1987 | Jackson | 439/849 |
| 5,094,636 | A | | 3/1992 | Zinn et al. | 439/839 |
| 5,545,055 | A | * | 8/1996 | Tanaka et al. | 439/507 |
| 5,634,819 | A | | 6/1997 | Pan et al. | 439/637 |
| 5,669,788 | A | * | 9/1997 | Brockman | 439/511 |
| 5,888,096 | A | | 3/1999 | Soes et al. | 439/610 |
| 6,146,213 | A | * | 11/2000 | Yoon | 439/716 |
| 6,319,071 | B1 | * | 11/2001 | Sato | 439/701 |
| 6,332,811 | B1 | * | 12/2001 | Sato | 439/701 |
| 6,343,960 | B1 | * | 2/2002 | Sato | 439/701 |
| 6,354,887 | B2 | * | 3/2002 | Maeda | 439/701 |
| 6,368,128 | B1 | | 4/2002 | Bäcker et al. | 439/189 |
| 6,375,518 | B2 | * | 4/2002 | Sato | 439/701 |
| 6,386,925 | B1 | * | 5/2002 | Sato et al. | 439/701 |
| 6,461,201 | B1 | * | 10/2002 | Maeda et al. | 439/701 |
| 6,478,624 | B2 | * | 11/2002 | Ramey et al. | 439/608 |
| 6,551,119 | B1 | * | 4/2003 | Sakamoto et al. | 439/287 |
| 6,573,453 | B2 | * | 6/2003 | Takada et al. | 174/72 A |
| 6,645,003 | B2 | * | 11/2003 | Yoshida et al. | 439/507 |
| 6,666,729 | B2 | * | 12/2003 | Takamura et al. | 439/723 |
| 6,730,057 | B2 | * | 5/2004 | Zhao et al. | 604/11 |
| 6,780,069 | B2 | * | 8/2004 | Scherer et al. | 439/752 |

FOREIGN PATENT DOCUMENTS

| | | |
|---|---|---|
| EP | 0635904 A3 | 4/1996 |
| EP | 0798810 A1 | 10/1997 |
| JP | 55-75983 | 5/1980 |
| JP | 2-5288 | 1/1990 |

OTHER PUBLICATIONS

Search Report from United Kingdom Patent Office, dated Oct. 15, 2004.

* cited by examiner

*Primary Examiner*—Gary Paumen
*Assistant Examiner*—Phuongchi Nguyen
(74) *Attorney, Agent, or Firm*—Armstrong, Kratz, Quintos, Hanson & Brooks, LLP.

(57) ABSTRACT

A notch 30 is provided at partitions 16, 26 and side walls 14, 24 to support slidably a coupling member 50 from a slide start to a slide end of the notch 30, said partitions and side walls partitioning terminal receiving chambers 18, 28. A resiliently clipping member 40 is provided at a terminal 35 to clip the coupling member 50 at the slide end of the notch 30. Further, the coupling member 50 has a thin joint piece, slidably contacting piece continued to the joint piece in a same plane, and a vertically contacting piece formed perpendicular to the slidably contacting piece. A wall to prevent the coupling member 50 from lateral displacement is provided at the notch 30, said wall being contacted with a side part of the coupling member 50.

8 Claims, 5 Drawing Sheets

JOINT CONNECTOR AND ITS TERMINALS

FIELD OF THE INVENTION

This invention relates to a joint connector and its terminals being applied to vehicles, such as a car, for forming a joint circuit either between wire harnesses interconnecting with each other, or between a wire harness and an apparatus.

DESCRIPTION OF THE RELATED ART

FIGS. 8 to 11 show some embodiments of the conventional technology relevant to this kind of joint connectors.

FIG. 8 (Patent document 1) shows a sectional view of a state where the joint terminal is inserted into a cavity in a connector housing. In a connector housing 60, a plurality of terminal receiving chambers 61 divided by partitions in a lattice shape are arranged in a vertical direction and in a horizontal direction (only one terminal receiving chamber 61 is shown in FIG. 8), and a female terminal 65 connected to an end of an electric wire 66 is received by each terminal receiving chamber 61. A cavity 62 communicates with the terminal-receiving chamber 61 through a narrow passage. A locking projection 63*a* for locking the female terminal 65 is provided at a back wall 63 of the cavity 62.

As shown in FIG. 9, a coupling member 67 has a joint piece 67*a* formed by punching a conductive substrate and being bent right-angled, a plurality of metal pieces 67*b* connected to the joint piece 67*a,* and a contact piece 67*c* formed by turning up a tip of the metal piece 67*b.* A width of the contact piece 67*c* is formed narrower than that of the metal pieces 67*b,* and a middle part of the metal pieces 67*b* is curved to add resiliency.

The coupling member 67 protrudes the contact piece 67*c* to the terminal receiving chambers 61 to crimp the contact piece 67*c* onto the female terminal 65. By connecting with the coupling member 67, a plurality of female terminals 65 form a joint circuit at a terminal side of a wire harness.

Next, FIG. 10 (Patent document 2) shows a sectional view of a state where the coupling member is inserted into a terminal-receiving chamber of a connector housing. The connector housing 70 is substantially the same composition as the connector housing 60 of the first conventional embodiment, and a plurality of terminal receiving chambers 71 are arranged in a lattice shape in the connector housing 70 (In FIG. 10, a pair of vertically arranged terminal receiving chambers 71 are shown horizontally). The female terminal 73 connected to an end of an electric wire 76 is received by each terminal receiving chamber 71. A front end opening 71*a,* to be engaged with the mating connector, has a wide mouth including a space to insert a coupling member 75.

As shown in FIG. 11, the coupling member 75 is made of conductive material such as phosphorus bronze, and formed in a corrugated band shape. This coupling member 75 has been pushed against its own spring power into a space between a partition 72, said partition 72 forming the terminal receiving chambers 71, and the female terminal 73, to press a swelling surface 75*a* of the coupling member 75 against the female terminals 73, to connect electrically the female terminals 73 with each other.

[Patent document 1]

Japanese Utility Model Application Laid-Open No. Hei 2-5288 (Page 5 to 8, FIG. 1 and 3)

[Patent document 2]

Japanese Utility Model Application Laid-Open No. Sho 55-75983 (Page 2 to 3, FIG. 4 and 5)

However, the conventional joint connector shown above has a problem as follows, which should be solved.

In the joint connector shown in the first conventional embodiment, since the cavity 62 for receiving the coupling member 67 is formed in the connector housing 60, there is a problem that the connector housing 60 becomes bulky in a vertical direction. In other words, in addition to the space for receiving a female terminal 65, a space for receiving a coupling member 67 is needed for the connector housing 60, thus there is a problem that the connector housing 60 becomes enlarged in a vertical direction.

In the joint connector shown in the second conventional embodiment, there is a worry that, when inserting the coupling member 75, the coupling member 75 might strike and deform the female terminal 73, or otherwise deform itself. This is because the coupling member 75 is pushed against its own spring power, without being guided, into the narrow space between the partitions 72 forming the terminal receiving chambers 71 and female terminals 73 in a state of blindness.

Further, there is a worry that a stable contact between the coupling member 75 and the female terminal 73 might not be maintained for a long time. Namely, since the coupling member 75 inserted between the partitions 72 and the female terminals 73 is not fixed in order not to move, there is a worry that the coupling member 75 might be shifted horizontally by vibrations of a vehicle body.

When the coupling member 75 is shifted horizontally, the swelling surface 75*a* of the coupling member 75 might be displaced from the female terminal 73 to decrease a contact area between the swelling surface 75*a* and the female terminal 73, to increase contact resistance.

This invention has been accomplished to solve the above described problems and an object of this invention is to provide a joint connector and its terminals, with which a workability of arranging wire harnesses of a joint circuit is improved, attachability and contact reliability between the terminal and a coupling member is improved, and a connector housing is prevented from becoming bulkier and is able to become smaller.

SUMMARY OF THE INVENTION

In order to attain the object, according to this invention, there is provided a joint connector comprising a terminal received by a terminal receiving chamber in a connector housing; and a coupling member to electrically connect a plurality of terminals with each other, wherein a supporting part to slidably support the coupling member is provided at a wall of the terminal receiving chamber, wherein a resiliently clipping member is provided at the terminal to clip the coupling member at a slide end of the supporting part, where the coupling member stops sliding.

According to the above composition, by connecting the joint circuit component to a plurality of terminals received by each terminal receiving chamber of the connector housing, the terminals are electrically connected with each other through the coupling member to make a joint circuit.

Moreover, since the coupling member is slidably supported, the joint circuit component can slide smoothly. At the slide end, the coupling member is clipped by the resiliently clipping member of the terminal, so that the terminal and the coupling member are jointly connected with each other. Therefore, attachability and reliability between the terminal and the joint connector are improved.

Preferably, according to this invention, there is provided the joint connector as described above, wherein the supporting part at the wall to slidably support the coupling member is a notch, wherein a positioning member, with which a side part of the coupling member comes into contact, is provided at starting side of a slidable part of the notch to prevent the coupling member from lateral displacement.

According to the above composition, since the coupling member is positioned at starting side of the slide, and guided during sliding, the coupling member can be prevented from striking and deforming the terminals, or deforming itself. Therefore, attachability between the coupling member and the terminal is improved.

Further, according to the invention, there is provided the joint connector as described above, wherein the supporting part at the wall to slidably support the coupling member is a notch, wherein an engaging part to prevent the coupling member from lateral displacement is provided at stopping side of a slidable part of the notch, wherein a mating part to be engaged with the engaging part is provided at the coupling member.

According to the above composition, the coupling member is prevented from horizontal displacement, so that a stable contact between the terminals and the coupling member is maintained. Therefore, reliability between the terminal and the coupling member is improved.

Further, according to the invention, there is provided the joint connector as described above, wherein the coupling member has a joint piece; a plurality of slidably contacting pieces being continued to the joint piece, and a vertically contacting piece being provided vertically on each slidably contacting piece, wherein the vertically contacting piece is clipped by the resiliently clipping members of the terminal.

According to the above composition, a back surface of the slidably contacting piece is a slidable surface on which the notch slidably contacts, so that the coupling member can slide in a direction that the connectors are engaged with each other. The joint piece and the slidably contacting piece can be continued together in a same plane, and this brings the coupling member into better balance so that the coupling member can slide more smoothly. Since the vertically contacting piece is provided vertically on the slidably contacting piece, the coupling member can be assembled in parallel with the terminal to prevent the connector housing from being bulky. Therefore, in addition to the effect described above, this prevents the connector housings from being bulky in a height direction and allows the connector housings to be smaller.

Further, according to the invention, there is provided a terminal comprising an electrically contacting part at one side; and an electric wire connecting part at the other side, wherein a resiliently clipping member is provided between the electric contact part and the electric wire connecting part to clip a coupling member, said coupling member connecting the terminals with each other.

According to the above composition, the coupling member is connected to the terminal directly, so that contact reliability is improved. Moreover, the coupling member is inserted smoothly, clipped resiliently with specified pressure, and jointly connected to the terminal. Therefore, the contact reliability of the joint connection is improved.

Further, according to the invention, there is provided the terminal as described above, wherein the resiliently clipping member has a rear anchor continued to the electric contact part and a pair of free ends, said free ends being continued to the rear anchor and clipping the coupling member.

According to the above composition, resiliency of the resiliently clipping member is improved so that the coupling member is inserted with a low insertion force. After insertion, the coupling member is clipped with resiliency of the pair of free ends to keep a stable contact between the terminal and the coupling member.

Further, according to the invention, there is provided the terminal as described above, wherein the pair of free ends is continued to the rear anchor and extended in a longitudinal direction of the electric contact part.

According to the above composition, a projection length of the pair of free ends can be lengthened, and resiliency of the pair of free ends can be improved.

Further, according to the invention, there is provided the terminal as described above, wherein while the pair of free ends is formed in a folded shape, a tip part of each free end rises in a direction orthogonal to the longitudinal direction of the electrically contacting part.

According to the above composition, a longitudinal length of the terminal can be shortened without loss of the resiliency of the pair of free ends. Since a tip part of each free end rises in a direction orthogonal to the longitudinal direction of the electrically contacting part, the coupling member is joint connected in a direction orthogonal to engaging direction of the connector. Further, by folding the free ends, the resiliency (length) of the resiliently clipping parts can be adjusted properly. Therefore, it is easy to attach the terminal into the coupling member.

Further, according to the invention, there is provided the terminal as described above, wherein the tip part of the resiliently clipping member is formed to have a tapered opening.

According to the above composition, the coupling member is clipped between the resiliently clipping member smoothly without any catch. Therefore, the attachability between the terminal and the coupling member is improved.

Further, according to the invention, there is provided the joint connector as described above, wherein the terminal as described above is used in the joint connector.

According to the above composition, the coupling member and the terminal can be assembled in parallel with each other, so that an inner space of the connector housing can be saved to prevent the connector housing from being bulky in the vertical direction. Especially, when the terminal as described above is used, in addition to the ability to prevent the connector housing from being bulky, a depth of the connector housing can be shortened. Further, since the connector housing can be prevented from being bulky in a vertical direction, a compact joint connector can be offered. Further, the attachability and the reliability between the terminal and the coupling member can be improved.

DESCRIPTION OF THE PREFERRED EMBODIMENT

Figure 7:
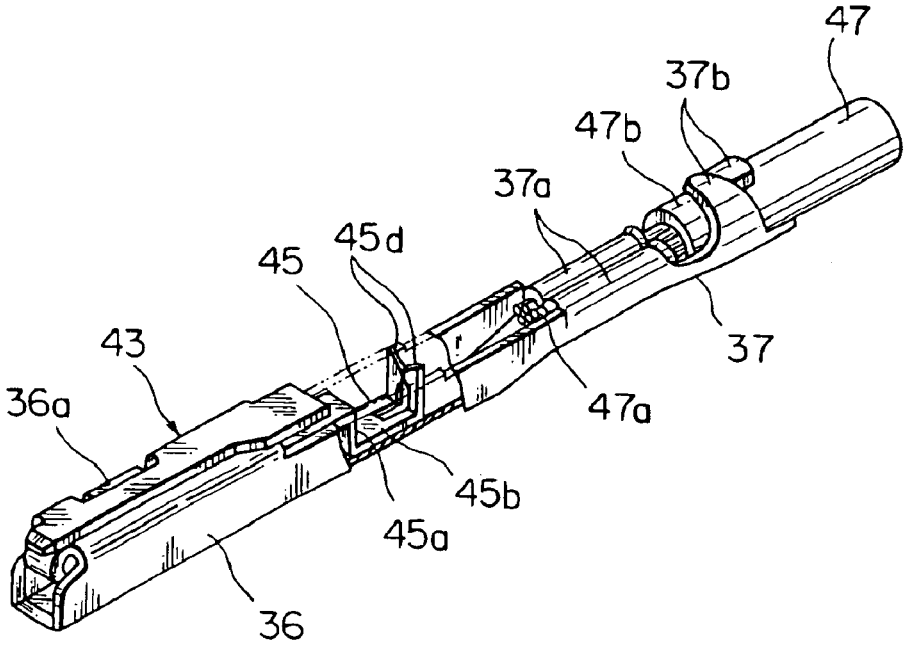
FIG. 7 is a perspective view showing a modification of the female terminal.

One embodiment of this invention will now be described with reference to the attached drawings. Each of FIGS. 1 to 5 shows one embodiment of a joint connector according to this invention, and FIGS. 6 and 7 shows one embodiment and one modified embodiment respectively of a terminal according to this invention.

The joint connector is a connector which jointly connects a coupling member to a plurality of terminals received in terminal receiving chambers respectively, whereby the terminals are short-circuited intentionally to be electrically common inside the connector housing, and connects to a mating connector (not shown) to make a joint circuit. As the mating connector, for example, a connector connected to an end of a wire harness, or a connector directly connected to an apparatus such as a motor, can be used.

The terminal is a metal terminal having two functions at once, one function is to connect wire harnesses with each other by connecting with a mating terminal, and the other function is to form a joint circuit by jointly connected to the coupling member.

First, the joint connector will be explained, next, the terminal will be explained.

According to this invention, there is provided a joint connector 10 of this invention comprising: a connector housing with two rows, having a plurality of terminal receiving chambers 18, 28 partitioned by partitions 16, 26 and side walls 14, 24, an upper row of said connector housing having an opening; a not-shown cover covering over the upper opening of the connector 22; a female terminal 35 received by each of terminal receiving chambers 18, 28; a joint bar (coupling member) 50 in a lateral chain shape for connecting electrically the female terminals 35 with each other to make a joint circuit, wherein a notch 30 is provided on the partitions 16, 26 and the side walls 14, 24 partitioning each of terminal receiving chambers 18, 28, said notch 30 slidably supporting the joint bar 50 from a start end to a stop end of a sliding path of the joint bar, wherein a resiliently clipping member 40 for clipping the joint bar 50 is provided on the female terminal 35 at the stop end of the sliding path in a tuning fork shape. Moreover, according to this invention, there is the joint connector as described above, wherein the joint bar has a thin joint piece 50, a plurality of slidably contacting pieces 52 continued to the joint piece 51 in a same plane, and a vertically contacting piece 53 provided vertically on each slidably contacting piece 52.

Main parts of the composition of the joint connector and their functions will be explained in detail below.

Figure 1:
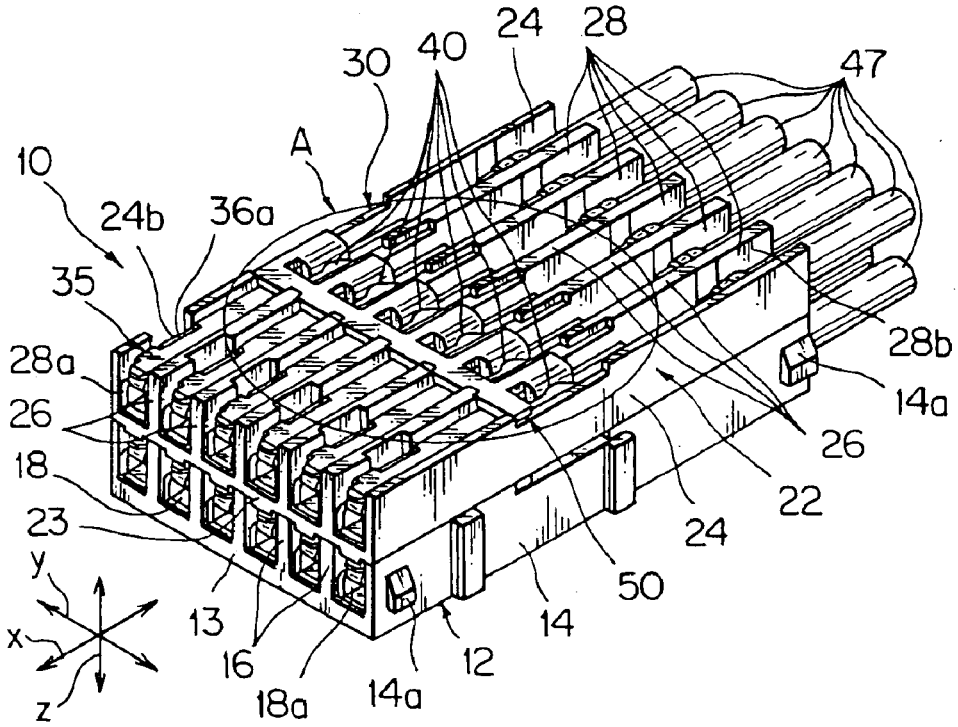
FIG. 1 is a perspective view showing one embodiment of a joint connector according to this invention.

As shown in FIG. 1, the joint connector 10 has the connector housings 12, 22, the cover, the female terminal 35, and the joint bar 50. Each connector housing is made of synthetic resin, fabricated by injection molding in a U shape, having an open upper part. An outer wall of the connector housing has bottom walls 13, 23, and side walls 14, 24 on the sides of the bottom walls 13, 23. The joint connector 10 has two rows, upper and lower rows, the lower one of which, as the connector housing 12, is overlapped by the upper row as the connector housing 22, the upper one of which, as the connector housing 22, is overlapped by the cover. The cover is locked by a projection 14 formed on the side wall 14 of the connector housing 14 as the lower row.

The side walls 14, 24 at the sides of the connector housings 12, 22 and partitions 16, 26 partition an inner space of the connector housings 12, 22 into a plurality of terminal receiving chambers 18, 23 extending in a depth direction of the connector housings 12, 22. The female terminal 35 shown in FIG. 6 is inserted into each of terminal receiving chambers 18, 28 from above, locked by a locking means, and fixed so as not to slip out from the terminal receiving chamber in a cross direction.

For convenience of explanation in this description, definitions of a vertical direction z, a cross direction x, and a horizontal direction y are defined as below. The vertical direction Z is defined as a direction to which the connector housings 12, 22 with two rows are stacked, the cross direction X is defined as a direction to which the connector is engaged, and the horizontal direction y is defined as a width direction of the connector housings 12, 22 perpendicular to both the vertical direction Z and the cross direction x.

An electric wire 47 connected to the female 35 is drawn out from a back end opening 28*b* of the connector housing 12 and 22 (a back end opening of the connector housing 22 not shown), and a not shown male terminal as a mating terminal penetrates from each of front end openings 18*a*, 28*a* of the connector housings 12, 22.

While the bottom wall 13 of the connector housing 12 as the lower row has a flat surface, the bottom wall 23 of the connector housing 22 located at the upper row has an uneven surface. Further, an upper part of the partition 16 of the connector housing 12 as the lower row and an upper part of the side wall 14 are engaged with a recess part of the bottom wall 23, so that the upper and lower rows as the connector housings 12, 22 can overlap each other without misalignment.

Engaging parts 24*b* and 26*a* for locking the male terminal 35 are provided at the partitions 16, 26 and side walls 14, 24 of the connector housing 12, 22. A locking part 36*a* is provided at a position of the female terminal 35 corresponding to these engaging parts 24*b*, 26*a*. By engaging the locking part 36*a* with the engaging parts 24*b*, 26*a*, the female terminal 35 is prevented from slipping out in the cross direction x.

Figure 2:
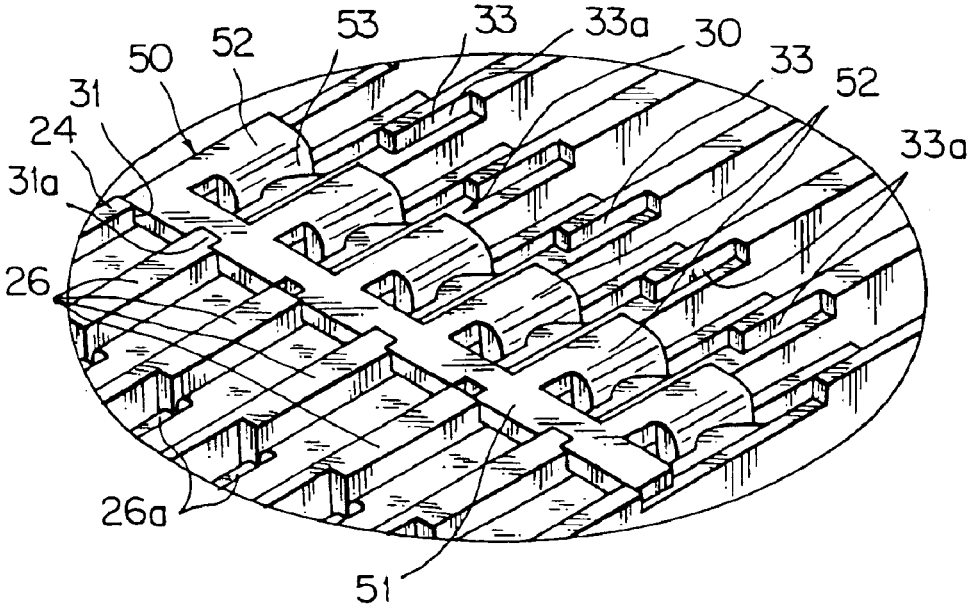
FIG. 2 is an enlarged view showing an area A in FIG. 1 of the joint connector.

A notch 30 to support slidably the joint bar 50 is formed at a middle of the partitions 16, 26 and side walls 14, 24. As shown in FIG. 2, the notch 30 is made by cutting a depth corresponding to a board thickness of the joint bar 50, so that an upper surface of the joint bar 50 is substantially flush with upper surfaces of partitions 16, 26 and side walls 14, 24. Namely, the joint bar 50 is set in the terminal receiving chambers 18, 28 without protruding beyond the connector housing 12 and 22. This saves the inner space of the connector housings 12, 22 to prevent them from being bulky.

Figure 4:
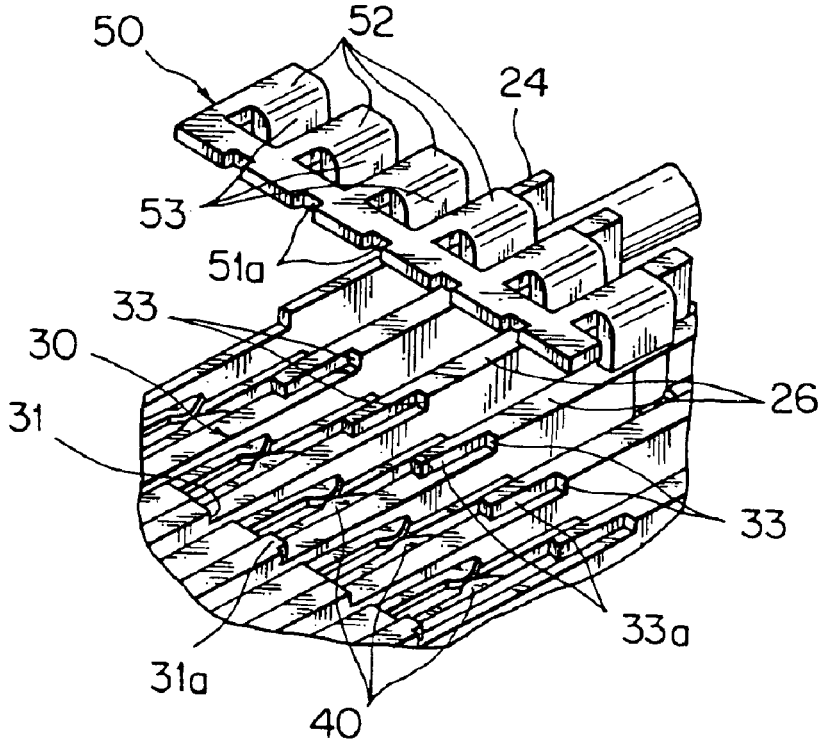
FIG. 4 is a perspective view showing a state of the joint bar shown in FIG. 3 before being attached to a connector housing shown in FIG. 1.

As shown in FIG. 4, a wall (positioning member) 33*a* to position without misalignment and guide slidably the joint bar 50 is formed at a back end part 33 of the notch 30 from which the joint bar 50 starts to slide. This wall 33*a* is a vertical wall of a groove formed straight in the cross direction x with an L shape section. A contact part (side part) 52*a* of the slidably contacting piece of the joint bar 50 contacts the wall 33*a*.

Figure 5:
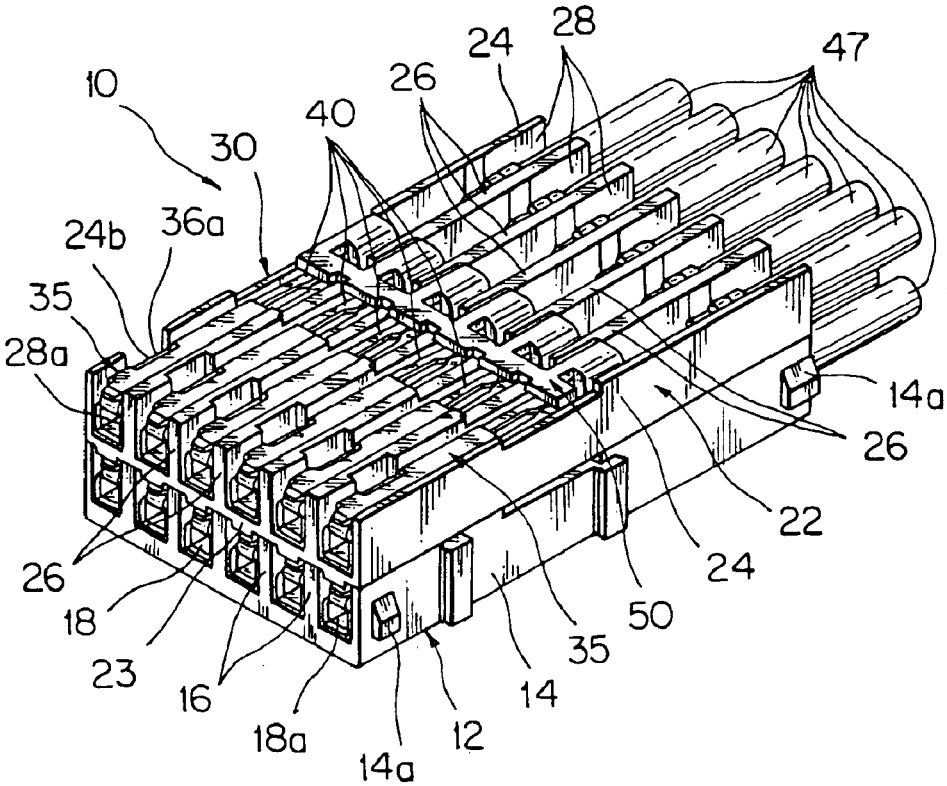
FIG. 5 is a perspective view showing a state of the joint bar shown in FIG. 3 being attached to the connector housing shown in FIG. 1.

As shown in FIG. 5, by the joint bar 50 being positioned at the slide start and slidably guided, the joint bar 50 is prevented from striking and deforming the female terminal 35, and also prevented from deforming itself.

An engaging projection (engaging part) 31*a* to prevent misalignment of the joint bar 50 in the horizontal direction after the joint connection is provided at a front end of the notch 30, said notch 30 being provided at a position where the joint bar 30 stops sliding. An engaging groove (engaged part) 51*a* formed on a joint piece 51 of the joint bar 50 is engaged with the engaging projection 31*a*.

As shown in FIG. 2, to position the joint bar 50 at the position where the joint bar 50 stops sliding prevents the joint bar 50 from floating freely in the horizontal direction (horizontal misalignment) to keep a stable contact between the female terminal 35 and the joint bar 50.

Figure 3:
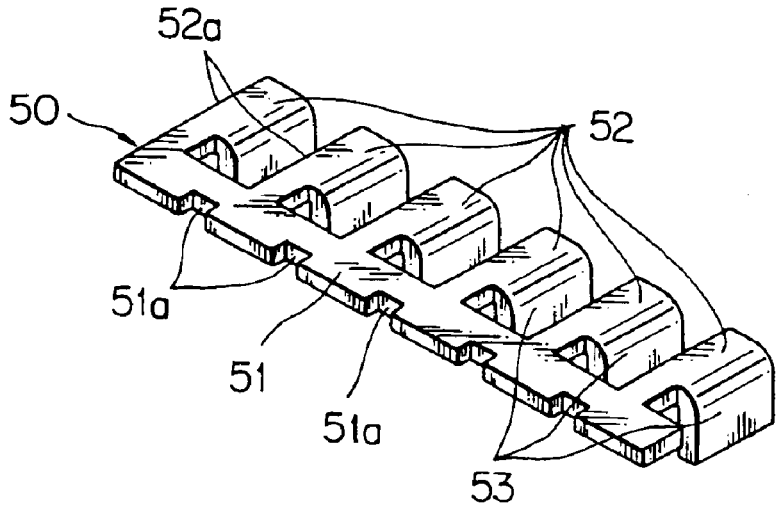
FIG. 3 is a perspective view showing a joint bar of the joint connector.

FIG. 3 shows a perspective view of the joint bar 50. The joint bar 50 is a so-called joint terminal formed in a thin board, horizontal chain shape by punching out a conductive substrate, and as described above, has the joint piece 51, a plurality of slidably contacting pieces 52 continued to the joint piece 51, and a vertically contacting piece 53 vertically formed on each slidably contacting piece 52.

The joint piece 51 and the slidably contacting piece 52 being continued to each other in a same plane, and back surfaces thereof, are flat slidable surfaces. The vertically contacting piece 53 is formed by folding perpendicularly downwardly a side part of the slidably contacting piece 52, which is initially in a L shape, and the adjacent vertically contacting pieces 53 are arranged in same pitches as the adjacent female terminals in the horizontal direction y. Additionally, the number of nodes of the joint bar 50 can be modified by cutting some of vertically contacting pieces 53 corresponding to a circuit form. Namely, by cutting some of the vertically contacting pieces 53, the number of the joint circuits can be modified optionally.

When connecting the joint bar 50 into the female terminal, by sliding the joint bar 50 from the slide start to the slide end of the notch 30, then pushing the vertically contacting piece 53 between the resiliently clipping members 40, the joint bar is clipped resiliently.

Figure 6A:
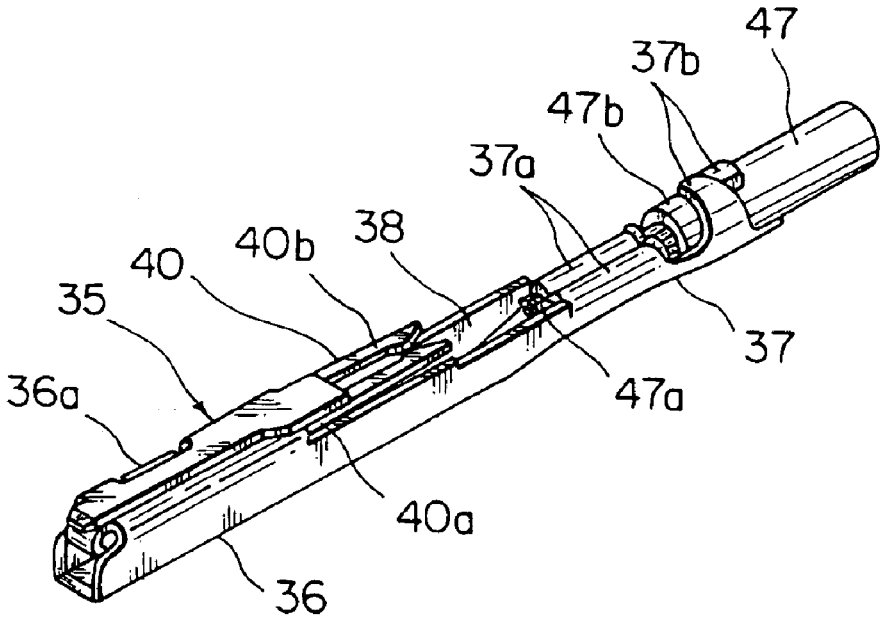
FIG. 6A is a whole perspective view showing a female terminal received by the connector housing shown in FIG. 1.
Figure 6B:
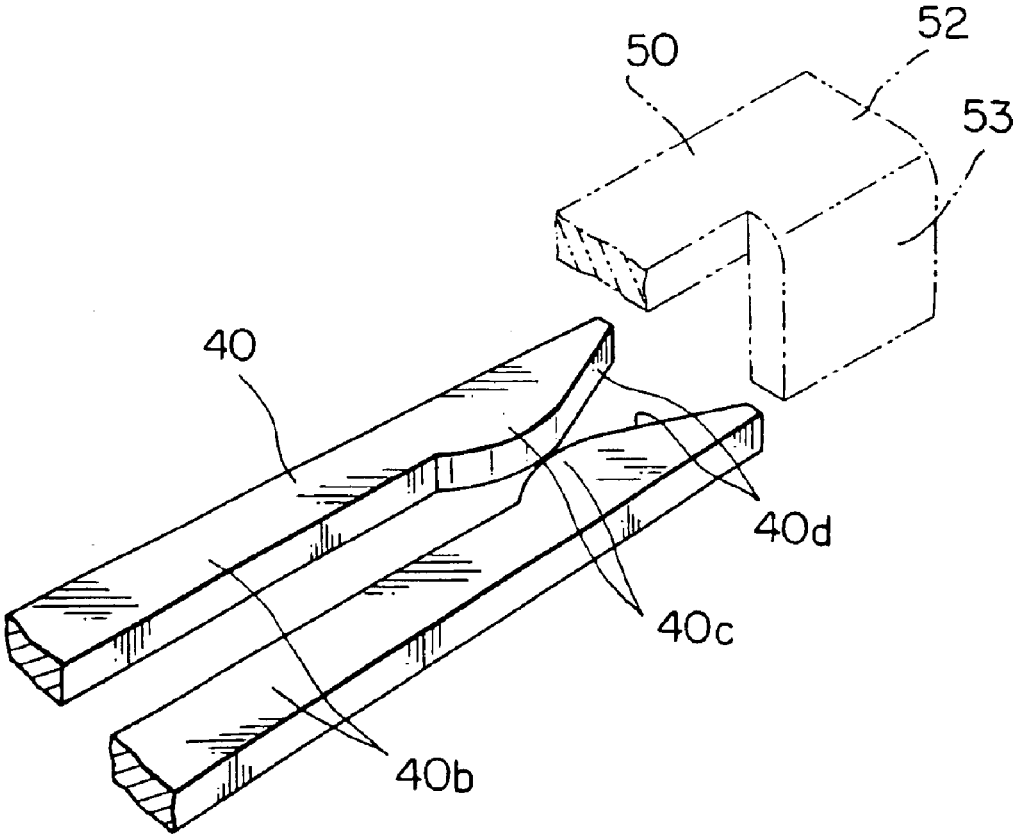
FIG. 6B is an enlarged view showing a resiliently clipping member of the female terminal shown in FIG. 6A.
Figure 8:
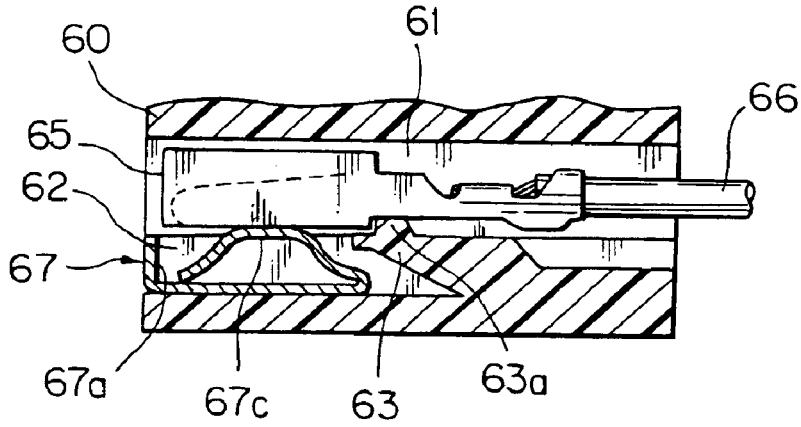
PRIOR ART FIG. 8
FIG. 8 is a section view showing one embodiment of a conventional joint connector.
Figure 9:
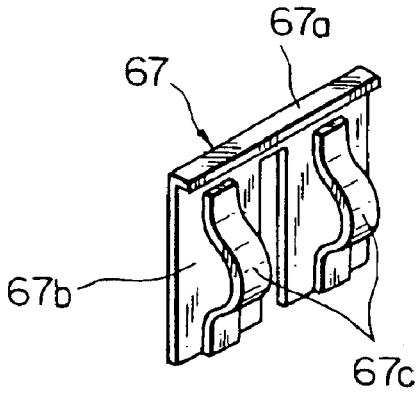
PRIOR ART FIG. 9
FIG. 9 is a perspective view showing a coupling member to be inserted to the joint connector shown in FIG. 8.
Figure 10:
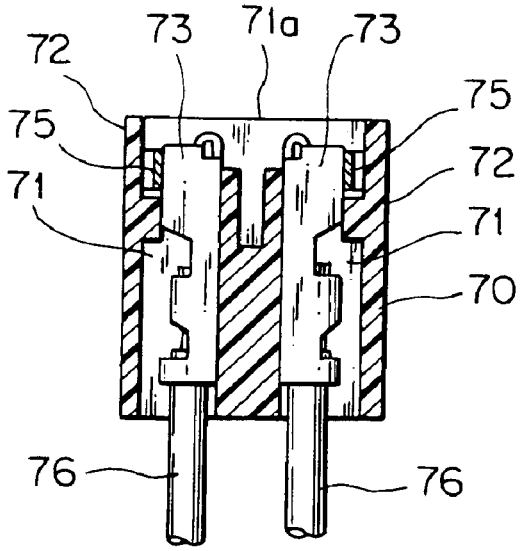
PRIOR ART FIG. 10
FIG. 10 is a section view showing another embodiment of the conventional joint connector.
Figure 11:
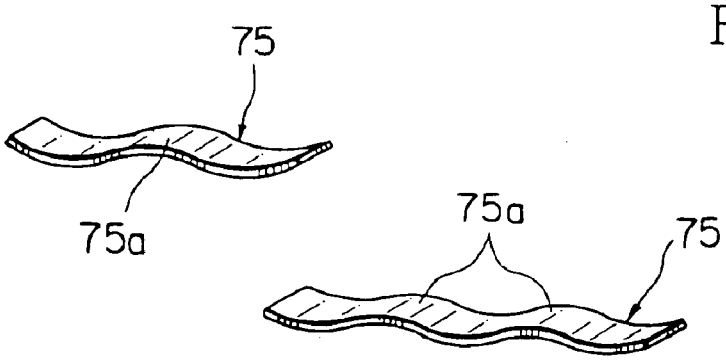
PRIOR ART FIG. 11
FIG. 11 is a perspective view showing a coupling member to be inserted into the joint connector shown in FIG. 10.

FIG. 6A and FIG. 6B show the female terminal 35 received by the connector housings 12, 22. FIG. 6A shows a perspective view of the whole female terminal 35. FIG. 6B shows an enlarged perspective view of the resiliently clipping member 40 of the female terminal 35 shown in FIG. 6A.

The female terminal 35 shown in FIG. 6A is formed by punching out and folding the conductive substrate. The female terminal 35 has an electrically contacting part 36 at one side, and an electric wire connecting part 37 continued to a body part 38 at the other side respectively, where the resiliently clipping member 40 extending straightly toward the electric wire connecting part 37 is formed integrally at the back of the electrically contacting part 36.

The electrically contacting part 36 is in a box shape, and a not-shown resilient contact piece to support resiliently an electric contact of the female terminal is formed inside the electrically contacting part 36. The electric wire connecting part 37 has two pair of crimping pieces 37*a*, 37*b* at its back and forth respectively. A core of the electric wire 47*a* is crimped with the pair of crimping pieces at forth side 37*a*, 37*a*. A sheath of the electric wire 47*b* is crimped with the pair of crimping pieces at the back side 37*b*, 37*b*.

The resiliently clipping member 40 has a rear anchor 40*a* and a pair of free ends 40*b* continued to the rear anchor 40*a*. A projection length of the free ends 40*b* is so suitable that resiliency and contactivity of the free ends 40*b* with the vertically contacting piece 53 of the joint bar 50 are improved. Therefore, the vertically contacting piece 53 is inserted between the free ends 40*b* extending in a longitudinal direction of the female terminal 35 with a low insertion force to jointly connect the female terminal 35 to the vertically contacting piece 53 easily, and the vertically contacting piece 53 is reliably clipped between the pair of the free ends 40*b*, 40*b* to maintain reliability of electrical connection.

A contact part 40*c* being bulgy inwardly and a slope part 40*d* continued to the contact part 40*c*, having a tapered opening, is formed at each top end of the free end 40*b*. The vertically contacting piece 53 of the joint bar 50 firstly is inserted into the tapered opening from out side of the slope part 40*d*, secondly is pushed into a depth of the resiliently clipping member 40 while expanding a gap between the contact parts 40*c* facing each other, and thirdly is clipped resiliently by resiliently restoring power of the free ends 40*b* being bent at their root as a fulcrum.

FIG. 7 shows a female terminal 43 as one modification of the female terminal 35. A same mark is attached and explained to the same composition as the female terminal 35 shown in FIG. 6. This female terminal 43 is formed by folding the pair of free ends 45*b* in a U shape, and rising the top end parts upward, orthogonal to a longitudinal direction of the female terminal 43. A free end 45*b* is formed inside a body 38 having a U-shaped section, and is not projected outside of the body 38. The joint bar 50 is inserted into the resiliently clipping member 45 from the top of the resiliently clipping member 35, and is clipped resiliently by the resiliently clipping member 45.

According to this modification, since the top end of the resiliently clipping member 45 is not positioned at the back side of the female terminal 43, but rises upward, the depth of the connector housings 12, 22 can be shortened. Moreover, since the free ends 45*b* is so folded in a U shape that the projection length of the free ends 45*b* is proper, the resiliency is also prevented from being damaged.

An assembling method of the joint connector according to this embodiment will be explained below.

Firstly, each terminal receiving chamber 18 of the connector housing 12 receives the female terminal 35 connected to an end of the electric wire 47. The female terminal 35 is locked in the cross direction x, by engaging the locking part 36*a* with the engaging parts 24*b*, 26*a*. Then, the joint bar 50 is set at the back end part 33 as the slide start of the notch 30. Since the wall 33*a* is formed at the slide start, the joint bar 50 is set without misalignment, and guided slidingly from the slide start to the slide end straightly.

By sliding the joint bar 50 along the notch 30, a top end surface of the joint piece comes into contact with a front end of the notch 30 as the slide end, and then the vertically contacting piece 53 is inserted into the resiliently clipping member 40 of the female terminal 35. At the slide end, the engaging projection 31*a* of the notch 30 is engaged with the engaging groove 51*a* of the joint piece 51 to prevent the joint bar 50 from horizontal misalignment, so that contact reliability between the female terminal 35 and the joint bar 50 can be maintained.

Next, the connector housing 22 of the upper row is stacked on the connector housing 12, then similarly, the female terminal 35 and the joint bar 50 are attached one by one, so that the female terminal 35 and the joint bar 50 are joint connected with each other. Next, the top connector housing 22 is covered with a cover, and the cover is locked with the connector housing 12 as the lower row. Additionally, the joint bar 50 is clipped and fixed between the connector housings 12, 22 as the lower and upper rows and between the connector housing 22 and the cover. The assembly of the joint connector 10 is ended above.

Thus, according to this embodiment, since the notch 30 to support slidably the joint bar 50 is provided at the partitions 16, 26 and the side walls 14, 24 partitioning the inner space of the connector housing into the terminal receiving chambers 18, 28, the joint bar 50 is assembled in parallel to the female terminals 34, 43 to prevent the connector housings 12, 22 from being bulky. Moreover, since the joint bar 50 is supported slidably by the notch 30 from the slide start to the slide end of the notch 30, the joint bar 50 can slide smoothly.

Moreover, since the resiliently clipping member 40 to clip the joint bar 50 can be provided at the female terminal 35, the joint bar 50 is inserted between the resiliently clipping member 40 of the female terminal 35 with a low insertion forth to clip the joint bar 50 resiliently with the female terminal 35 at the slide end of the notch 30.

Additionally, the joint connector 10 of this embodiment has two rows, upper and lower rows, but not limited to two rows, and can have one, three or more rows.

Further, it is also effective that the front end part of the vertically contacting piece 53 of the joint bar 50 is formed in a taper shape. By forming the front end part in a taper shape, the vertically contacting piece 53 can be inserted smoothly into the resiliently clipping member 40 of the female terminal 35.

Moreover, this invention is not limited to above embodiments, and can be modified variously and carried out without departing from the spirit and scope of this invention.

What is claimed is:

1. A joint connector comprising:

a terminal received by a terminal receiving chamber in a connector housing; and a coupling member to electrically connect a plurality of terminals with each other, wherein a supporting part to slidably support the coupling member is provided at a wall of the terminal receiving chamber, the supporting part being arranged to form a sliding path along a lengthwise direction of a wire received by the terminal, wherein a resiliently clipping member is provided at the terminal to clip the coupling member at a slide end of the supporting part.

2. The joint connector as claimed in claim 1, wherein the supporting part at the wall to slidably support the coupling member is a notch, wherein a positioning member, with which a side part of the coupling member comes into contact, is provided at starting side of a slidable part of the notch to prevent the coupling member from lateral displacement.

3. The joint connector as claimed in claim 1, wherein the supporting part at the wall to slidably support the coupling member is a notch, wherein an engaging part to prevent the coupling member from lateral displacement is provided at stopping side of a slidable part of the notch, wherein a mating part to be engaged with the engaging part is provided at the coupling member.

4. The joint connector as described in claim 1, wherein a terminal is used in the joint connector, wherein the terminal comprises:

an electrically contacting part at one side; and an electric wire connecting part at the other side, wherein a resiliently clipping member is provided between the electric contact part and the electric wire connecting part to clip a coupling member, said coupling member connecting the terminals with each other.

5. A joint connector comprising:

a terminal received by a terminal receiving chamber in a connector housing; and a coupling member to electrically connect a plurality of terminals with each other, wherein a supporting part to slidably support the coupling member is provided at a wall of the terminal receiving chamber, wherein a resiliently clipping member is provided at the terminal to clip the coupling member at a slide end of the supporting part, wherein the coupling member has a joint piece, a plurality of slidably contacting pieces being continued to the joint piece, and a vertically contacting piece being provided vertically on each slidably contacting piece, wherein the vertically contacting piece is clipped by the resiliently clipping members of the terminal.

6. A terminal comprising:

an electrically contacting part at one side; and an electric wire connecting part at the other side, wherein a resiliently clipping member is provided between the electric contact part and the electric wire connecting part to clip a coupling member, said coupling member connecting the terminals with each other, wherein the resiliently clipping member has a rear anchor continued to the electric contact part and a pair of free ends, said free ends being continued to the rear anchor and clipping the coupling member.

7. The terminal as described in claim 6, wherein the pair of free ends is continued to the rear anchor and extended in a longitudinal direction of the electric contact part.

8. The terminal as described in claim 6, wherein while the pair of free ends is formed in a folded shape, a tip part of each free end rises in a direction orthogonal to the longitudinal direction of the electrically contacting part.

* * * * *